US006663382B2

(12) United States Patent
Li

(10) Patent No.: US 6,663,382 B2
(45) Date of Patent: Dec. 16, 2003

(54) SAFETY LIGHTER

(76) Inventor: Kin Chung Li, 2211 S. Hacienda Blvd., Suite 107, Hacienda Heights, CA (US) 91754

( * ) Notice: Subject to any disclaimer, the term of this patent is extended or adjusted under 35 U.S.C. 154(b) by 0 days.

(21) Appl. No.: 09/839,800

(22) Filed: Apr. 19, 2001

(65) Prior Publication Data

US 2002/0155407 A1 Oct. 24, 2002

(51) Int. Cl.[7] ..... F23Q 1/02
(52) U.S. Cl. ..... 431/153; 431/276; 431/277
(58) Field of Search ..... 431/153, 276, 431/277

(56) References Cited

U.S. PATENT DOCUMENTS 5,096,414 A 3/1992 Zellweger
5,547,370 A 8/1996 Hwang
5,913,674 A * 6/1999 Shimizu ..... 431/153
6,220,853 B1 * 4/2001 Luo ..... 431/153

FOREIGN PATENT DOCUMENTS

WO WO 98/04869 A1 * 2/1998

* cited by examiner

*Primary Examiner*—Henry Bennett
*Assistant Examiner*—James Barrow
(74) *Attorney, Agent, or Firm*—Raymond Y. Chan; David and Raymond Patent Group

(57) ABSTRACT

A safety lighter includes two wheels axles coaxially supported on two sides of a spark wheel respectively. Two driving wheels, each having a receiving cavity provided on an out side of said driving wheel, are supported by two driven bodies of the wheel axles respectively wherein each driving wheel is adapted for turning on the respective driven body in a free rotating manner. Two positioning discs are disposed in the receiving cavities of the two driving wheels and firmly supported by the two driven bodies of the two wheel axles respectively wherein the positioning discs are adapted to hold the two driving wheels in position respectively, so as to prevent lateral movements of the driving wheels with respect to the wheel axles.

18 Claims, 2 Drawing Sheets

SAFETY LIGHTER

CROSS REFERENCE OF RELATED APPLICATION

This is an improved non-provisional application of another non-provisional application, U.S. Pat. No. 5,913,674, issued on Jun. 22, 1999, assigned to the applicant of the present invention.

BACKGROUND OF THE PRESENT INVENTION

1. Field of Invention

The present invention relates to disposable lighter, and more particularly to a safety lighter for preventing the minor to ignite the lighter so as to guarantee the safety of children.

2. Description of Related Arts

The traditional disposable lighters are popular because they are easy to ignite and operate.

However, for protecting the safety and benefit of children, starting from 1993 to 1994, the U.S. Consumer Product Safety Commission declared that it should stop selling the traditional disposable lighter. In view of protecting the safety of children, it is absolutely necessary and reasonable to do so. Therefore, the U.S. Consumer Product Safety Commission imposed an important regulation that "Child below 4 years old cannot light the lighter".

Accordingly, various kinds of disposable lighter having switching mechanism for rendering the lighter being child resistant are developed. Typical examples include the U.S. Pat. No. 5,096,414 issued to Zellweger and the U.S. Pat. No. 5,547,370 issued to Hwang. In order to improve the drawbacks of both the Zellweger's and Hwang's patents, a safety lighter was invented, U.S. Pat. No. 5,913,674, which was issued on Jun. 22, 1999 and assigned to the applicant of the present invention.

According to the disclosure of the U.S. Pat. No. 5,913,674, the driving wheels are arranged loosely rotatable around the driven bodies when the driving wheels have not been depressed. When a depressing force is applied downwardly to the driving wheels, the driving grooves are pressed to engage with the driven spurs of the two driven bodies. Therefore, when the driving wheels are depressed and turned, the two driven bodies are driven to strike the spark wheel against the flint. However, since the driving holes of the driving wheels must be larger than the driven bodies so as to render the driving wheels being loosely rotatable around the driven bodies normally. In other words, the driving wheels are loosely put on the driven bodies, so that laterally movement may be occurred for the unstable driving wheels during the rotation around the smaller driven bodies that may adversely affect the ignition operation of the lighter.

SUMMARY OF THE PRESENT INVENTION

A main object of the present invention is to provide a safety lighter that can prevent the minor, especially under 4 years old, to ignite the lighter so as to guarantee the safety of children, wherein the driving wheels are better supported in a stable and a free rotatable manner that can guide the rotation of the driving wheels effectively.

Another object of the present invention is to provide a safety lighter having two positioning discs provided on two outer sides of two driving wheels respectively, so as to prevent lateral movements of the two driving wheels with respect to the wheel axles and ensure the spark wheel being driven by the driving wheels.

Another object of the present invention is to provide a safety lighter wherein the spark wheel can be easily mounted on a central position between the two supporting walls. Since the spark wheel is supported by the two wheel axles on both sides respectively, the two wheel axles can substantially prevent the spark wheel to move aside, so that the spark wheel can permanently remain in a central position, between the two wheel axles.

Another object of the present invention is to provide a safety lighter, which does not require incorporating with any additional element in order to provide safety feature for preventing the children to ignite the lighter. Moreover, the assemble of the spark wheel and the two wheel axles are as simple and easy as studding two inner ends of the two wheel axles to the two side holes of the spark wheel respectively. Therefore, the manufacturing cost and process of the present invention can thus be remained as usual.

Accordingly, in order to accomplish the above objects, the present invention provides a safety lighter, comprising:

a supporting frame disposed on a gas reservoir having a valve which is actuated by a gas lever pivotally mounted on the supporting frame for actuating the valve to release gas within the gas reservoir therefrom, wherein the supporting frame comprises two supporting walls parallelly protruded on opposite sides of the gas lever and each of the supporting walls has a supporting hole provided thereon; and an ignition means comprising:

a flint supported by a resilient element;

a spark wheel which is rotatably mounted on the supporting frame and has a striking surface in contact with the flint, wherein the flint is retained urging against the striking surface of the spark wheel by means of the resilient element for generating sparks directed toward the valve when the striking surface is driven to strike against, and that two sides of the spark wheel each has an axle hole, a periphery of each of the axle holes having a plurality of evenly spaced engaging indentions;

two wheel axles, each having a round supporting axle for rotatably inserting into one of the supporting holes, a driving axle for inserting into one of the axle holes of the spark wheel, wherein a periphery of the driving axle has a plurality of evenly spaced protrusions adapted for firmly engaging with the engaging indentions of the axle hole of the spark wheel, and-a round driven body integrally formed between the supporting axle and the driving axle, wherein a plurality of axial driven spurs are evenly spaced and protruded on an outer circular surface of the driven body;

two driving wheels, which are supported by the two driven bodies of the two wheel axles respectively, each having an outer knurling surface, a central driving hole having a diameter larger than that of the driven body so as to enable the driving wheel to loosely rotate around the driven body without being depressed, and a receiving cavity which is indented on an outer side of the driving wheel and has a diameter larger than that of the central driving hole, wherein a plurality of axial driving grooves are evenly spaced and indented around a periphery of the driving hole, thereby when a depressing force is applied downwardly to the two driving wheels, the driving grooves thereof are pressed to engage with the driven spurs of the two driven bodies, so that when the driving wheels are depressed and turned, the two driven bodies are driven to strike the spark wheel against the flint; and two positioning discs, which are disposed in the receiving cavities of the two driving wheels and supported by the two driven bodies of the two wheel axles respectively, each having a center hole adapted for fittedly engaging with an outer portion of the respective driven body, whereby the two driving wheels are guided to rotate between two sides of the spark wheel and the two positioning discs respectively so as to prevent lateral movement of the driving wheels during rotation.

BRIEF DESCRIPTION OF THE DRAWINGS

FIG. 4 is an exploded perspective view of a safety lighter according to a second preferred embodiment of the present invention.

FIG. 5 is s sectional end view of the safety lighter according to the above second embodiment of the present invention.

FIG. 6 is a partial side view of the driving wheel of the safety lighter according to the above second preferred embodiment of the present invention, illustrating the relationship between the driving wheel and the respective driven body.

DETAILED DESCRIPTION OF THE PREFERRED EMBODIMENT

Figure 1:
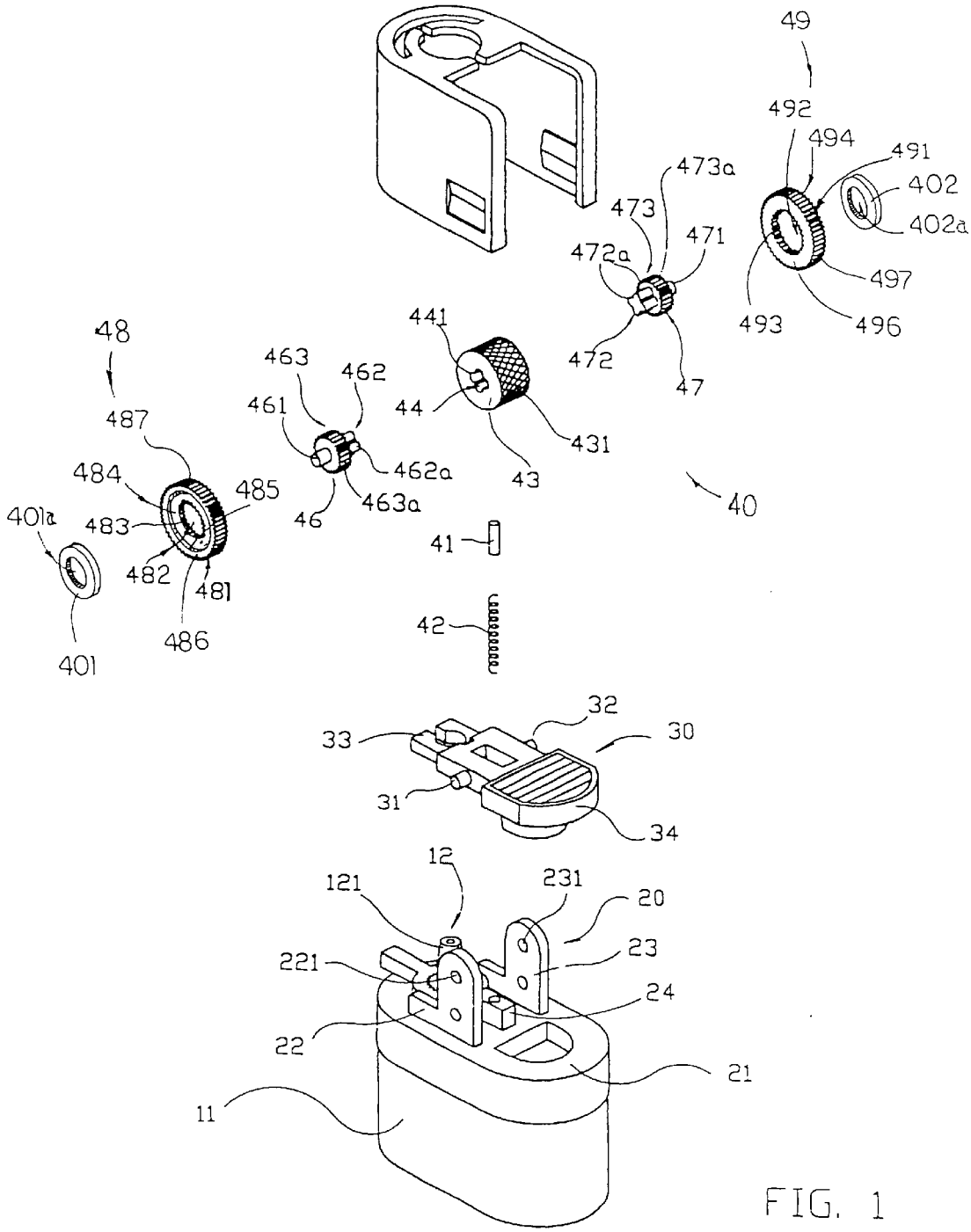
FIG. 1 is an exploded perspective view of a safety lighter according to a first preferred embodiment of the present invention.
Figure 3:
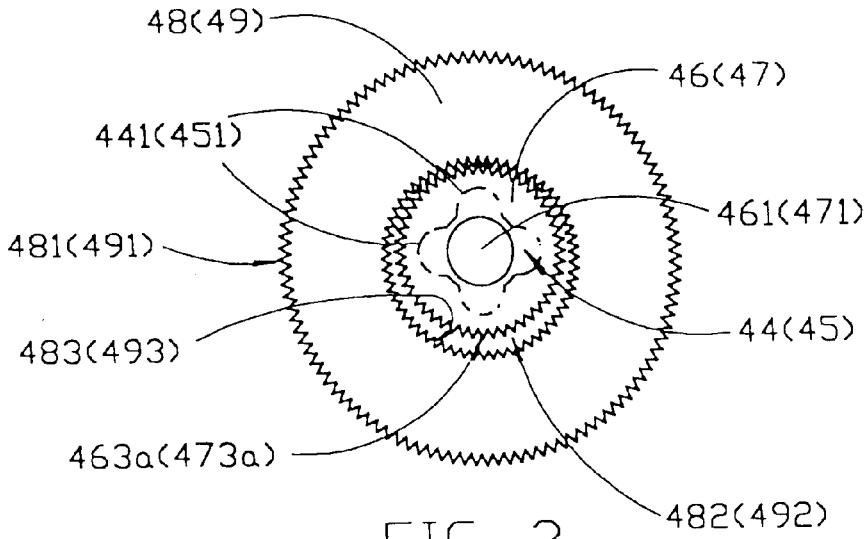
FIG. 3 is a partial side view of a driving wheel of the safety lighter according to the above first preferred embodiment of the present invention, illustrating the relationship between the driving wheel and the respective driven body.
Figure 2:
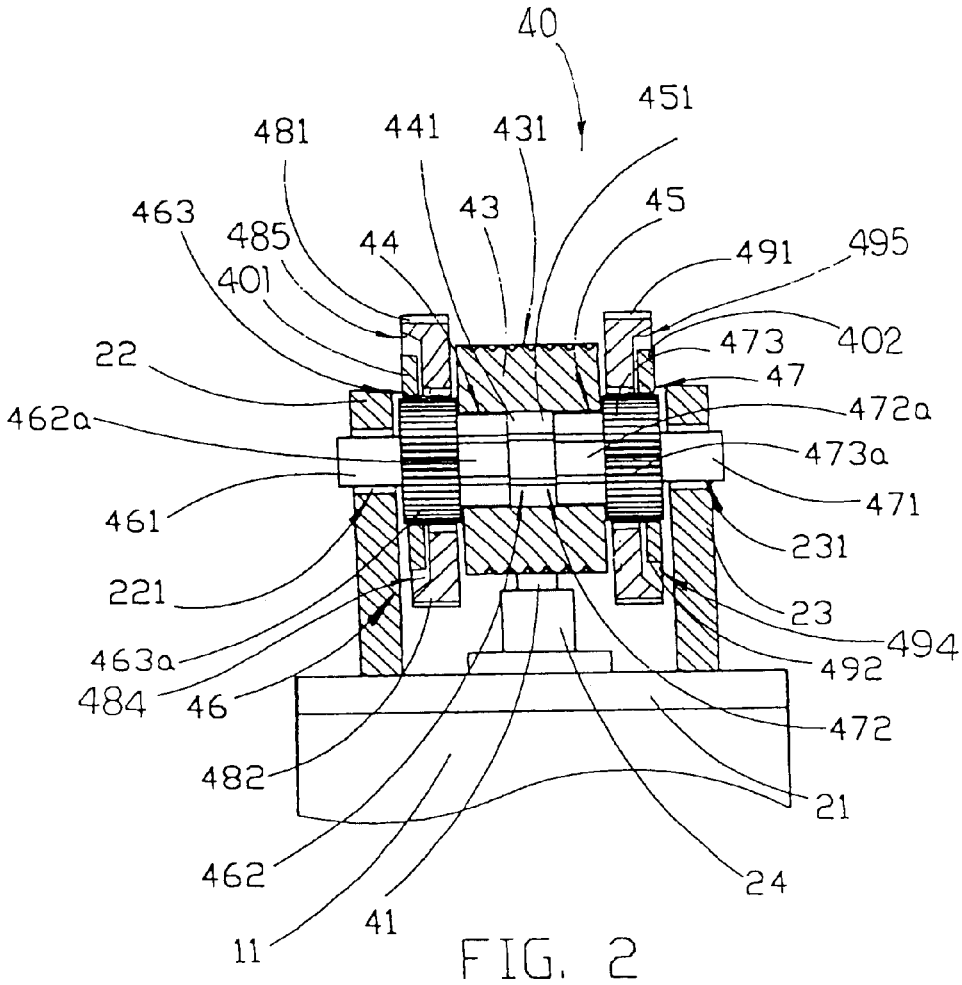
FIG. 2 is a sectional end view of the safety lighter according to the above first preferred embodiment of the present invention.

Referring to FIGS. 1 through 3 of the drawings, a safety lighter according to a preferred embodiment of the present invention is illustrated, wherein the safety lighter comprises a supporting frame 20 and an ignition means 40. The supporting frame 20 is disposed on a gas reservoir 11 having a valve 12 which is actuated by a gas lever 30 pivotally mounted on the supporting frame 20 for releasing gas therefrom. The supporting frame 20 is protruded from a frame cover 21 which is sealedly secured onto the gas reservoir 11 filled with liquid petroleum gas such as butane therein.

The supporting frame 20 comprises a pair of supporting walls 22, 23 protruded on opposite sides of the gas lever 30. The gas lever 30 is pivotally mounted between the two supporting walls 22, 23 by means of two pivots 31, 32 protruded from two opposite sides of the gas lever 30. The gas lever 30 has a front end 33 extending frontward to engage with a nozzle 121 of the gas valve 12 and a depressible rear end 34 extending rearwards of the frame cover 21 for enabling the depressing of the depressible rear end 34 for lifting up the gas nozzle 121 to open the gas valve 12.

The ignition means 40 comprises a flint 41 supported by a resilient element 42 and a spark wheel 43 which is rotatably mounted on the supporting frame 20. The spark wheel 43 has an outer circular striking surface 431 contacting with the flint 41.

The flint 41 and the resilient element 42 are received in a flint housing 24 which is underneath the spark wheel 43 and provided on the frame cover 21 between the two supporting walls 22, 23. An upper portion of the flint 41 must be retained exposing outside the flint housing 24 and urging against the striking surface 431 of the spark wheel 43 by means of the resilient element 42 for generating sparks directed toward the gas valve 12 when the striking surface 431 is driven to turn against the flint 41.

Each of the supporting walls 22, 23 has a circular supporting hole 221, 231 provided therein for mounting the spark wheel 43 between the two supporting walls 22, 23. Each side of the spark wheel 43 has an axle hole 44, 45 which periphery has a plurality of evenly spaced engaging indentions 441, 451.

The ignition means 40 further comprises two wheel axles 46, 47 and two driving wheels 48, 49. Each of the driving wheels 48, 49 has an outer knurling surface 481, 491 adapted for better contact by a user. Each of the wheel axle 46, 47 has a round supporting axle 461, 471 for rotatably inserting into the respective circular supporting hole 221, 231 of the two supporting walls 22, 23, a driving axle 462, 472 for inserting into the respective axle hole 44, 45 of the spark wheel 43, wherein a periphery of the driving axle 462, 472 has a plurality of evenly spaced protrusions 462*a*, 472*a* adapted for firmly engaging with the respective engaging indentions 441, 451 of the corresponding axle hole 44, 45 of the spark wheel 43, and a round driven body 463, 473 integrally formed between the supporting axle 461, 471 and the driving axle 462, 472, wherein the driven body 463, 473 has a diameter at least equal to a maximum size of the driving axle 462, 472 and larger than that of the supporting axle 461, 471. Axial driven spurs 463*a*, 473*a* are evenly spaced and protruded on an outer circular surface of the driven body 463, 473.

The two driving wheels 48, 49 are supported by the two driven bodies 463, 473 of the two wheel axles 46, 47 respectively. Each of the driving wheels 48, 49 has a central driving hole 482, 492 having a diameter larger than that of the driven body 463, 473 and a plurality of axial driving grooves 483, 493 evenly spaced and indented around a periphery thereof, so as to enable the driving wheel 48, 49 to loosely rotate around the driven body 463, 473 when the driving wheels 48, 49 has not been depressed. Each of the driving wheels 48, 49 has a diameter larger than that of the central driving hole 482, 492 and has a circular receiving cavity 484, 494 coaxially indented in an outer side of the driving wheel 48, 49. Thereby, when a depressing force applied downwardly to the two driving wheels 48, 49 presses the driving grooves 483, 493 to engage with the driven spurs 463*a*, 473*a* of the two driven bodies 463, 473, so that when the driving wheels 48, 49 are depressed and turned, the two driven bodies 463, 473 are driven to strike the spark wheel 43 against the flint 41.

The ignition means 40 further comprises two positioning discs 401, 402 which are disposed in the receiving cavities 484, 494 of the two driving wheels 48, 49 and supported by the two driven bodies 463, 473, wherein each positioning disc 401, 402 has a center hole 401*a*, 402*a* adapted for fittedly engaging with an outer portion of the respective driven body 463, 473. In order words, the two positioning discs 401, 402 are supported by the two driven bodies 463, 473 of the two wheel axles 46, 47 by inserting the driven bodies 463, 473 into the center holes 401*a*, 402*a* respectively. Whereby, the two driving wheels 48, 49 are guided to rotate between two sides of the spark wheel 43 and the two positioning discs 401, 402 respectively so as to prevent lateral movement of the driving wheels 48, 49 during the rotation with respect to the wheel axles 46, 47.

Accordingly, each driving wheel 48, 49 has a U-shaped cross section and comprises a circular wheel member 486, 496 and a driving ring 487, 497 integrally and perpendicularly extended from a circular edge of the wheel member 486, 496, wherein the central driving hole 482, 492 is provided at the center of the wheel member 486, 496 and the receiving cavity 484, 494 is defined on the outer side of the wheel member 486, 496 and within the driving ring 487, 497.

A diameter of each receiving cavity 484, 494 is gradually decreasing from an outer portion of the driving wheel 48, 49 to an inner portion thereof so as to define a slanted inner circumferential wall 485, 495 of the receiving cavity 484, 494 of the driving wheel 48, 49. In other words, the driving ring 487, 497 has a thickness gradually decreasing from its outer portion to an inner portion thereof, so that the contacting area of the outer knurling surface 481, 491 of each of the driving rings 487, 497 of the two driving wheels 48, 49 is maximized, as large as the previous U.S. Pat. No. 5,913,674 while providing the receiving cavity 484, 494.

A diameter of each of the positioning discs 401, 402 is smaller than that of the respective receiving cavity 484, 494 so as to ensure the driving wheels 48, 49 rotating in a free rotation manner. Thus, a width of the driven body 463, 473 should be larger than that of the positioning disc 401, 402, such that the positioning disc 401, 402 is securely mounted on the respective driven body 463, 473 of the wheel axle 46, 47.

Since each driving wheel 48, 49 is securely sandwiched between the wheel axle 46, 47 and the positioning disc 401, 402, the driving wheels 48, 49 are locked up on the driven bodies 463, 473 in position respectively so as to prevent any lateral movement of the driving wheels 48, 49 with respect to the wheel axles 46, 47. However, each driving wheel 48, 49 is adapted for turning on the respective driven body 463, 473 in a free rotating manner so as to prevent any unwanted ignition of the safety lighter.

According to the first preferred embodiment of the present invention, as shown in FIGS. 1 to 3, each of the axle holes 44, 45 of the spark wheel 43 has totally four engaging indentions 441, 451 perpendicularly and outwardly extended so as to form a cross shaped cross section. Moreover, the two axle holes 44, 45 can be inwardly extended to form a through hole. Relatively, each of the two driving axles 462, 472 has totally four protrusions 462*a*, 472*a* perpendicularly and outwardly extended to form a cross shaped cross section, wherein the two cross shaped driving axles 462, 472 are arranged to fittedly insert into the two cross shaped axle holes 44, 45 of the spark wheel 43 respectively until the two driving bodies 463, 473 are pressed against the two sides of the spark wheel 43. Therefore, when either one of the two driving axles 462, 472 rotates, the spark wheel 43 can be exactly driven to rotate without slipping. The two driving axles 462, 472 may be made in tapered form, so as to facilitate the manufacturer to plug the slightly smaller ends thereof into the two axle holes 44, 45 of the spark wheel 43 respectively.

As shown in FIG. 2, the more deeper of the driving axle 462, 472 to be inserted into the respective axle hole 44, 45, the engagement of the driving axle 462, 472 with the spark wheel 43 will be tighter. Furthermore, the spark wheel 43 is rigidly supported between the two wheel axles 46, 47 according to the present invention, so as to rotatably mount between the two supporting walls 22, 23. In other words, the spark wheel 43 is permanently located at a central position between the supporting walls 22, 23 and aligned on top of the flint 41. The two wheel axles 46, 47 substantially limit and hold the spark wheel 43 in a central position that absolutely prevents the spark wheel 43 from moving aside. Therefore, the best striking on the flint 41 can be always achieved.

According to the first preferred embodiment, the driven spurs 463*a*, 473*a* on the driven bodies 463, 473 are in wave form, which are adapted to fittedly engage with the driving grooves 483, 493 of the driving hole 482, 492 of the two driving wheels 48, 49 respectively when the two driving wheels 48, 49 are downwardly depressed. Therefore, to depress and strike on the two driving wheels 48, 49 at the same time can drive the two wheel axles 46, 47 to turn. Then, the two wheel axles 46, 47 drive the spark wheel 43 to rotate and strike against the flint 41 to generate sparks.

Referring to FIGS. 4 to 6, a second preferred embodiment of the present invention is illustrated, which is similar to the above first embodiment, except that an alternative mode of the ignition means 40 is disclosed. The ignition means 40 also comprises two wheel axles 46', 47' and two driving wheels 48', 49'. Similarly, each of the wheel axles 46', 47' has a round supporting axle 461', 471' for rotatably inserting into the respective circular supporting hole 221, 231 of the respective supporting wall 22, 23, a driving axle 462', 472', and a driven body 463', 473', wherein the driving axle 462', 472' and the driven body 463', 473' have the same diameter and the protrusions 462*a*', 472*a*' on the driving axle 462' 472' and the driven spurs 463*a*', 437*a*' on the driven body 463', 473' are longitudinal semi-circular protruding ribs evenly spaced and extended from the driving axle 462', 472' to the driven body 463', 473'. An isolating rim 464', 474' can be formed between the driving axle 462', 472' and the driven body 463', 473', so that the driving axle 462', 472' can be precisely inserted into the respective axle hole 44', 45' of the spark wheel 43' until the isolating rim 464', 474' is pressed against the corresponding side of the spark wheel 43'.

Relatively, the engaging indentions 441', 451' on the axle holes 44', 45' of the spark wheel 43' and the driving grooves 483', 493' on the driving holes 482', 492' of the driving wheels 48', 49' are also arranged in semi-circular shaped for engaging with the semi-circular protruding ribs as mentioned above. The second preferred embodiment works and operates similar to the above first preferred embodiment. Moreover, like the above first embodiment, each of the two driving wheels 48', 49' of the second embodiment also provides a central driving hole 482', 492' having a diameter larger than that of the driven body 463', 473' so as to enable the driving wheel 48', 49' to loosely rotate around the driven body 463', 473' without being depressed, and a circular receiving cavity 484', 494' which is indented in an outer side of the driving wheel 48', 49' and has a diameter larger than that of the central driving hole 482', 492', wherein a plurality of axial driving grooves 483', 493' are evenly spaced and indented around a periphery of the driving hole 482', 492', thereby when a depressing force is applied downwardly to the two driving wheels 48', 49', the driving grooves 483', 493' thereof are pressed to engage with the driven spurs 463*a*', 473' of the two driven bodies 463', 473', so that when the driving wheels 48', 49' are depressed and turned, the two driven bodies 463', 473' are driven to strike the spark wheel 43' against the flint 41'.

The ignition means 40 further comprises two positioning discs 401', 402', which are disposed in the receiving cavities 484', 494' of the two driving wheels 48', 49' and supported by the two driven bodies 463', 473' respectively, each having a center hole 401*a*', 402*a*' adapted for fittedly engaging with an outer portion of the respective driven body 463', 473', whereby the two driving wheels 48', 49' are guided to rotate between two sides of the spark wheel 43' and the two positioning discs 401', 402' respectively so as to prevent lateral movement of the driving wheels 48', 49' during rotation with respect to the wheel axles 46', 47'.

What is claimed is:

1. A safety lighter, comprising:

a supporting frame disposed on a gas reservoir having a valve which is actuated by a gas lever pivotally mounted on said supporting frame for actuating said valve to release gas within said gas reservoir therefrom, wherein said supporting frame comprises two supporting walls parallelly protruded on opposite sides of said gas lever and each of said supporting walls has a supporting hole provided thereon; and an ignition means comprising:

a flint supported by a resilient element;

a spark wheel which is rotatably mounted on said supporting frame and has a striking surface in contact with said flint, wherein said flint is retained urging against said striking surface of said spark wheel by means of said resilient element for generating sparks directed toward said valve when said striking surface is driven to strike against, and that two sides of said spark wheel each has an axle hole, a periphery of each of said axle holes having a plurality of evenly spaced engaging indentions;

two wheel axles, each having a round supporting axle, being rotatably inserted into said supporting holes respectively, a driving axle inserted into one of said axle holes of said spark wheel respectively wherein a periphery of each of said driving axles has a plurality of evenly spaced protrusions adapted for firmly engaging with said engaging indentions of said axle hole of said spark wheel, and a round driven body integrally formed between said supporting axle and said driving axle, wherein a plurality of axial driven spurs is evenly spaced and protruded on an outer circular surface of said driven body;

two driving wheels, which are supported by said two driven bodies of said two wheel axles respectively, each having an outer knurling surface, a central driving hole having a diameter larger than that of said driven body so as to enable said driving wheel to loosely rotate around said driven body without being depressed, and a receiving cavity which is indented on an outer side of said driving wheel and has a diameter larger than that of said central driving hole, wherein a plurality of axial driving grooves is evenly spaced and indented around a periphery of said driving hole, thereby when a depressing force is applied downwardly to said two driving wheels, said driving grooves thereof are pressed to engage with said driven spurs of said two driven bodies, so that when said driving wheels are depressed and turned, said two driven bodies are driven to strike said spark wheel against said flint; and two positioning discs which are disposed in said receiving cavities of said two driving wheels and supported by said two driven bodies of said two wheel axles respectively, wherein each of said positioning discs has a center hole adapted for fittedly engaging with an outer portion of said driven body, wherein said two driving wheels are guided to rotate between two sides of said spark wheel and said two positioning discs respectively so as to prevent lateral movement of said driving wheels during rotation.

2. A safety lighter, as recited in claim 1, wherein a diameter of each said receiving cavity of said driving wheels is gradually decreasing from an outer portion of said driving wheel to an inner portion thereof so as to define a slanted inner circumferential wall of said receiving cavity of said driving wheel.

3. A safety lighter, as recited in claim 2, wherein a diameter of said positioning disc is smaller that that of said receiving cavity so as to ensure said driving wheels rotating in a free rotation manner.

4. A safety lighter, as recited in claim 1, wherein each of said axle holes of said spark wheel has totally four engaging indentions perpendicularly and outwardly extended, and each of said two driving axles has totally four protrusions perpendicularly and outwardly extended, wherein said two driving axles are arranged to fittedly insert into said two axle holes of said spark wheel respectively until said two driving bodies are pressed against said two sides of said spark wheel.

5. A safety lighter, as recited in claim 3, wherein each of said axle holes of said spark wheel has totally four engaging indentions perpendicularly and outwardly extended, and each of said two driving axles has totally four protrusions perpendicularly and outwardly extended, wherein said two driving axles are arranged to fittedly insert into said two axle holes of said spark wheel respectively until said two driving bodies are pressed against said two sides of said spark wheel.

6. A safety lighter, as recited in claim 1, wherein said two axle holes are inwardly extended to form a through hole.

7. A safety lighter, as recited in claim 5, wherein said two axle holes are inwardly extended to form a through hole.

8. A safety lighter, as recited in claim 1, wherein said driven spurs on said driven bodies are in wave form, which are adapted to fittedly engage with said driving grooves of said driving holes of said two driving wheels respectively when said two driving wheels are downwardly depressed.

9. A safety lighter, as recited in claim 3, wherein said driven spurs on said driven bodies are in wave form, which are adapted to fittedly engage with said driving grooves of said driving holes of said two driving wheels respectively when said two driving wheels are downwardly depressed.

10. A safety lighter, as recited in claim 5, wherein said driven spurs on said driven bodies are in wave form, which are adapted to fittedly engage with said driving grooves of said driving holes of said two driving wheels respectively when said two driving wheels are downwardly depressed.

11. A safety lighter, as recited in claim 7, wherein said driven spurs on said driven bodies are in wave form, which are adapted to fittedly engage with said driving grooves of said driving holes of said two driving wheels respectively when said two driving wheels are downwardly depressed.

12. A safety lighter, as recited in claim 6, wherein said driven spurs on said driven bodies are in wave form, which are adapted to fittedly engage with said driving grooves of said driving holes of said two driving wheels respectively when said two driving wheels are downwardly depressed.

13. A safety lighter, as recited in claim 1, wherein each of said driving axles and each of said driven bodies have a same diameter, and said protrusions on each of said driving axles and said driven spurs on each of said driven bodies are longitudinal semi-circular protruding ribs evenly spaced and extended from said driving axle to said driven body.

14. A safety lighter, as recited in claim 3, wherein each of said driving axles and each of said driven bodies have a same diameter, and said protrusions on each of said driving axles and said driven spurs on each of said driven bodies are longitudinal semi-circular protruding ribs evenly spaced and extended from said driving axle to said driven body.

15. A safety lighter, as recited in claim 13, wherein an isolating rim is formed between said driving axle and said driven body of each of said wheel axles such that said driving axle is able to be precisely inserted into said respective axle hole of said spark wheel until said isolating rim is pressed against said corresponding side of said spark wheel.

16. A safety lighter, as recited in claim 14, wherein an isolating rim is formed between said driving axle and said driven body of each of said wheel axles such that said driving axle is able to be precisely inserted into said respective axle hole of said spark wheel until said isolating rim is pressed against said corresponding side of said spark wheel.

17. A safety lighter, as recited in claim 13, wherein said engaging indentions on said axle holes of said spark wheel and said driving grooves on said driving holes of said driving wheels are also arranged in semi-circular shaped for engaging with said semi-circular protruding ribs.

18. A safety lighter, as recited in claim 16, wherein said engaging indentions on said axle holes of said spark wheel and said driving grooves on said driving holes of said driving wheels are also arranged in semi-circular shaped for engaging with said semi-circular protruding ribs.

* * * * *